US011161131B2

(12) United States Patent
Wollin

(10) Patent No.: US 11,161,131 B2
(45) Date of Patent: Nov. 2, 2021

(54) SPRAY NOZZLE FOR A SPRAY TOOL

(71) Applicant: WOLLIN GMBH, Lorch (DE)

(72) Inventor: Bjoern Wollin, Lorch (DE)

(73) Assignee: Wollin GMBH, Lorch (DE)

( * ) Notice: Subject to any disclaimer, the term of this patent is extended or adjusted under 35 U.S.C. 154(b) by 0 days.

(21) Appl. No.: 16/812,429

(22) Filed: Mar. 9, 2020

(65) Prior Publication Data

US 2020/0206762 A1 Jul. 2, 2020

Related U.S. Application Data

(63) Continuation-in-part of application No. PCT/DE2018/100767, filed on Sep. 11, 2018.

(30) Foreign Application Priority Data

Sep. 14, 2017 (DE) ..... 10 2017 121 274.4

(51) Int. Cl.
*B05B 11/04* (2006.01)
*B05B 1/16* (2006.01)
*B22D 17/20* (2006.01)

(52) U.S. Cl.
CPC ..... *B05B 11/047* (2013.01); *B05B 1/1681* (2013.01); *B22D 17/2007* (2013.01)

(58) Field of Classification Search
CPC ... B05B 11/047; B05B 1/1681; B05B 15/534; B05B 7/0483; B05B 1/302; B05B 9/0413; B22D 17/2007; F04B 17/05; F04B 15/02; F04B 53/06
See application file for complete search history.

(56) References Cited

U.S. PATENT DOCUMENTS 2,348,151 A * 5/1944 Rotter ..... F04B 7/04 222/75
4,410,302 A 10/1983 Chiba et al.
4,990,066 A 2/1991 Kern
(Continued)

FOREIGN PATENT DOCUMENTS

DE 10 28 846 A 4/1958
DE 2 318 713 A1 10/1974
(Continued)

OTHER PUBLICATIONS

English translation of the International Search Report for the corresponding international application No. PCT/DE2018/100767, dated Dec. 6, 2018 (3 pages).
(Continued)

*Primary Examiner* — Donnell A Long
(74) *Attorney, Agent, or Firm* — Ronald S. Lombard

(57) ABSTRACT

In a spray nozzle with a nozzle housing including a dosing chamber for accommodating a release agent to be sprayed into a mold via a discharge line including a check valve and a nozzle body and a venting unit integrated into the nozzle housing for venting air from the spray nozzle, the volume of the dosing chamber is adjustable and the venting unit is activatable by an activation signal by which the venting unit is moved from a dysfunctional position to a venting and opening position in which the check valve is held open by the venting unit for venting the dosing chamber and the discharge line, via the nozzle body.

4 Claims, 4 Drawing Sheets

(56) References Cited

U.S. PATENT DOCUMENTS

| | | | | |
|---|---|---|---|---|
| 6,168,390 | B1 | 1/2001 | Hunklinger et al. | |
| 6,299,413 | B1 | 10/2001 | Stahlman et al. | |
| 2003/0194328 | A1* | 10/2003 | Bryant | F04B 53/06 417/53 |
| 2008/0197209 | A1* | 8/2008 | Ganzer | B05B 7/1254 239/8 |
| 2014/0084025 | A1* | 3/2014 | Tix | F02G 5/00 222/135 |
| 2017/0326282 | A1* | 11/2017 | Wilt | A61M 1/3638 |
| 2018/0215549 | A1* | 8/2018 | Johnson | F04B 15/02 |

FOREIGN PATENT DOCUMENTS

| | | | | |
|---|---|---|---|---|
| DE | 2318713 | A1 * | 10/1974 | F04B 53/06 |
| DE | 196 14 957 | A1 | 10/1997 | |
| DE | 103 37 689 | A1 | 3/2005 | |
| DE | 10 2005 038 166 | A1 | 2/2007 | |
| DE | 10 2008 035 632 | B4 | 7/2011 | |
| JP | 5280721 | B2 | 9/2013 | |
| WO | WO 03/062638 | A1 | 7/2003 | |

OTHER PUBLICATIONS

International Search Report for the corresponding international application No. PCT/DE2018/100767, dated Dec. 6, 2018 (3 pages), in the German language.

DE 22 04 942 B, dated Aug. 16, 1973, Germany, no English translation.

DE 10 2004 020 205 A1, dated Nov. 10, 2005, Germany, no English translation.

EP 0 724 486 B1, dated Apr. 27, 1995, EPO—Germany, no English translation.

English translation of the "Written Opinion of the International Searching Authority" for the corresponding international application No. PCT/DE2018/100767, (5 pages).

"Written Opinion of the International Searching Authority" for the corresponding international application No. PCT/DE2018/100767, (6 pages), in the German language.

* cited by examiner

SPRAY NOZZLE FOR A SPRAY TOOL

CROSS-REFERENCE TO RELATED APPLICATIONS

This is a continuation-in-part application of pending international patent application PCT/DE2018/100767 filed Sep. 11, 2018 and claiming the priority of German patent application 10 2017 121 274.4 filed Sep. 14, 2017. The said international patent application PCT/DE2018/100767 and the said German patent application 10 2017 121 274.4 are both incorporated herein by reference in their entireties as though fully set forth.

BACKGROUND OF THE INVENTION

The invention relates to a spray nozzle for a spraying tool for the application of a release agent to a casting mold.

Such a spray nozzle is disclosed in DE 10 2008 035 632 B4. This spray nozzle includes in a nozzle housing a dosing chamber into which a release agent can be introduced. The volume of the dosing chamber can be changed via a discharge piston. By actuating the discharge piston the release agent is displaced from the dosing chamber and conducted, via a discharge passage, to a nozzle body which includes an outwardly open cavity in which spray air is added to the release agent before its discharge.

The dosing chamber is provided with a venting channel for the venting of a gas volume in the dosing chamber.

Concerning additional state of the art references, reference is made to EP 0 724 486 BI, DE 196 14 957 AI, DE 22 04 942 B and DE 10 2004 020 205 AI.

It is the object of the present invention to provide a spray nozzle for a spraying tool which can be effectively vented by simple measures.

SUMMARY OF THE INVENTION

In a spray nozzle with a nozzle housing including a dosing chamber for accommodating a release agent to be sprayed into a mold via a discharge line including a check valve and a nozzle body and a venting unit integrated into the nozzle housing for venting air from the spray nozzle, the volume of the dosing chamber is adjustable and the venting unit is activatable by an activation signal by which the venting unit is moved from a dysfunctional position to a venting and opening position in which the check valve is held open by the venting unit for venting the dosing chamber and the discharge line, via the nozzle body. Preferably the spray nozzle operation is controlled by a common control air supply which, below a certain threshold pressure, controls the dosing chamber volume but, above a certain, higher, threshold pressure activates additionally the venting unit while holding the check valve open when the venting unit is activated.

The dosing element is in the form of an expulsion piston which can execute a control movement in the direction of the longitudinal piston axis.

During a regular normal operation the release agent displaced from the dosing chamber by the control movement of the dosing element is discharged from the nozzle housing via a discharge channel to a nozzle element. If appropriate, a spray medium, in particular compressed air, is added to the release agent in order to discharge the release agent from the nozzle element in the form of a spray cloud.

The spray nozzle includes an integral active venting unit for venting the dosing chamber and, if applicable, the discharge channel which is in communication with the dosing chamber. Venting is required when air has collected in the dosing chamber or, respectively, in the discharge channel whereby a discharge of the release agent is prevented or at least negatively affected. Because of the compressibility of the air in the dosing chamber the control movement of the dosing element is not or only partially converted into a displacement of the release agent. For a proper functioning of the spray nozzle any air collected in the dosing chamber needs to be vented.

The air is vented via the active venting unit in that an activation signal is applied to the venting unit whereupon the venting unit is automatically adjusted from a dysfunctional position to a venting and opening position. With a proper functioning of the spray nozzle that is without any air collected in the dosing chamber by the release agent, the venting unit or a component operated by the venting unit is moved to the venting and opening position permitting the release agent to pass the venting unit. If air is present in the dosing chamber the venting unit or a component activated by the venting unit can be moved by application of the activation signal automatically to the venting and opening position in which the dosing chamber is vented. Upon completion of the venting, the venting unit is again returned from the venting and opening position to the dysfunctional position whereby the normal functional operability of the spray nozzle is re-established and normal operation of the spray nozzle can be resumed.

Because of the automatic operation of the venting unit a manual opening and closing for the venting procedure is eliminated. The venting unit is activated by the activation signal which supplies the energy for transferring the venting unit from the dysfunctional position to the venting and opening position and which controls the movement of the venting unit. Movement of the venting unit into the dysfunctional position is obtained either also in an active manner by applying an activation signal to the venting unit or in a passive manner by a force permanently applied to the venting unit in a direction toward its dysfunctional position such as the spring force of a spring element or the force generated by the weight of the venting unit or another component which acts on the venting unit. The movement of the venting unit from the dysfunctional to the venting and opening position is obtained by the activation signal acting in a direction opposite the direction of the return force biasing the venting unit into the dysfunctional position.

The venting of the spray nozzle can also be manually initiated by providing the activation signal manually so that the venting unit is moved from the dysfunctional position to the venting and opening position. Alternatively the automatic adjustment movement of the venting from the dysfunctional position to the venting and opening position may be initiated by monitoring a system value, for example the pressure of the release agent in the area of the nozzle body or in the discharge channel and automatically activating the venting unit by applying the activating signal to the venting unit depending on the height of the system value. As system value for example also an optical surveillance of the spray pattern of the release agent out of the nozzle body may be taken into consideration wherein the venting unit is activated when it is optically determined that the release agent is not sprayed out or not in the desired form.

In an advantageous development the activation signal for the venting unit is the same as the activation signal for the dosing member which is used for a volume change of the dosing chamber and the discharge of the release agent from dosing chamber. The activation signal is for example based on pressurized control air which is applied to the dosing member as well as to the venting unit. The control air for the dosing member and the venting unit may be supplied via a common control air duct also to the spray nozzle. Alternatively, the control air for the dosing member and the control air for the venting unit may be supplied via separate control air ducts.

The control air is pressurized wherein below a certain air pressure threshold value, only the dosing member is activated and, above the air pressure threshold value, both the dosing member and the venting unit are activated.

Advantageously, there is a lower compressed air threshold value and a higher, upper, compressed air threshold value which are for example at 6 bar and 8 bar, wherein below the lower threshold value only the dosing member is activated and above the upper threshold value both, the dosing member as well as the venting unit are activated. This procedure has the advantage that, during normal operation, with the venting unit in the dysfunctional position, the dosing member can be activated by the pressurized air and/or with control pressure corresponding to the lower threshold value whereas, for the venting, the control air pressure value only needs to be increased to the upper threshold value in order to move the venting unit into the venting and opening position. Because of the pressure difference between the lower and the upper pressurized air threshold value there is a security spacing which prevents an unintended activation of the venting unit. Since for the venting procedure both, the dosing member and the venting unit are activated it is made sure that, with the activation of the dosing member, any air is removed from the dosing chamber via the nozzle body in spite of the high compressibility of the air in the dosing chamber.

Also other activation values may be taken into consideration for activating the venting unit. As another activation value for example, an electric current may be used by which an electric venting unit, for example, in the form of an electromagnetic activator is energized. Also the dosing member may be electrically activated. Alternatively, the venting unit and/or the dosing member may be hydraulically activated.

It is advantageous to use the same activation medium for both, the dosing member and the venting unit. But, alternatively, it is also possible to use different activation media for the dosing member and the venting unit, for example control air for the dosing member and electric current or hydraulic pressure for the venting unit.

In the discharge channel a check valve is arranged which can be activated by the venting unit from a blocking position to an open position for venting the system. For the duration of the venting process the check valve remains in the open position in which the air in the dosing chamber and possibly residual release agent is discharged from the dosing chamber via the discharge channel and the nozzle body. Also, during normal operation, wherein the venting unit is in the dysfunctional position, the check valve is opened during the discharge of the release agent. At the end of the discharge procedure—during normal operation as well as at the end of the venting procedure—the check valve returns to the blocking position in which the discharge channel is blocked.

In an advantageous embodiment, the check valve comprises a blocking ball which is arranged in the discharge channel and is movable therein between a blocking and an opening position.

In an advantageous embodiment of the invention the venting unit is in the form of a venting piston which is movable along its longitudinal axis between the dysfunctional position and the venting and opening position. During normal operation without any air in the dosing chamber, the venting piston is in the axially retracted dysfunctional position. Upon activation of the venting piston, in particular by control air whose pressure is above an upper air pressure threshold value, the venting piston is moved axially out of the dysfunctional position into the venting and opening position and presses the check valve, that is in particular the blocking ball, out of its blocking into its opening position in which the check valve remains for the duration of the venting procedure. To end the venting procedure activation of the venting piston is stopped whereby the venting piston returns to its dysfunctional position for example by its weight. However, the venting piston may also be spring-biased for returning it to its dysfunctional position.

It may also be expedient to provide additionally for a manual venting procedure for venting the spray nozzle. To this end a by-pass may be provided which can be opened manually for the venting of the dosing chamber.

In accordance with a further advantageous embodiment, the dosing volume of the dosing chamber may be adjustable by means of a displacement element which may, for example, be in the form of a set screw which is screwed into the dosing chamber housing and which can be adjusted from without. The front end of the set screw forms an abutment and support area for the dosing member, the base position of which depends on the position of the set screw. With an adjustment movement of the set screw the volume of the dosing chamber can be changed.

The invention will become more readily apparent from the following description of a particular embodiment thereof described below with reference to the accompanying drawings.

DESCRIPTION OF A PARTICULAR EMBODIMENT

Figure 1:
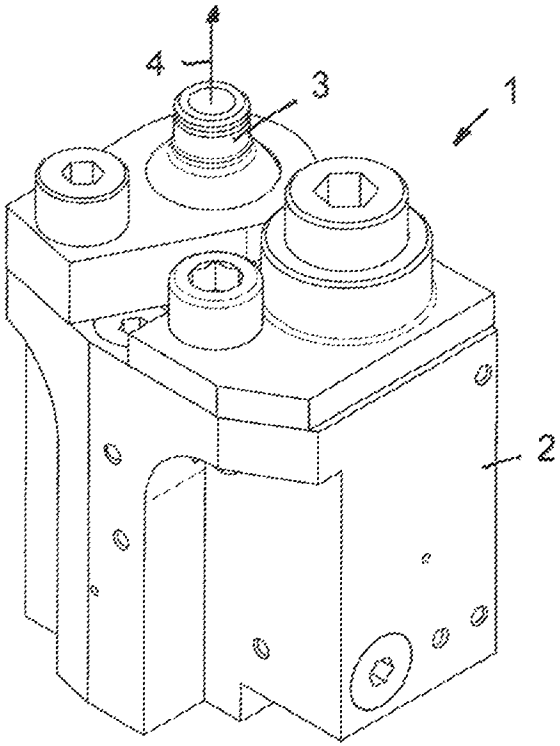
FIG. 1 is a perspective view of a spray nozzle for a spray tool for spraying a release agent via a nozzle body.

In the figures identical components are designated by the same reference numerals.

Figure 2:
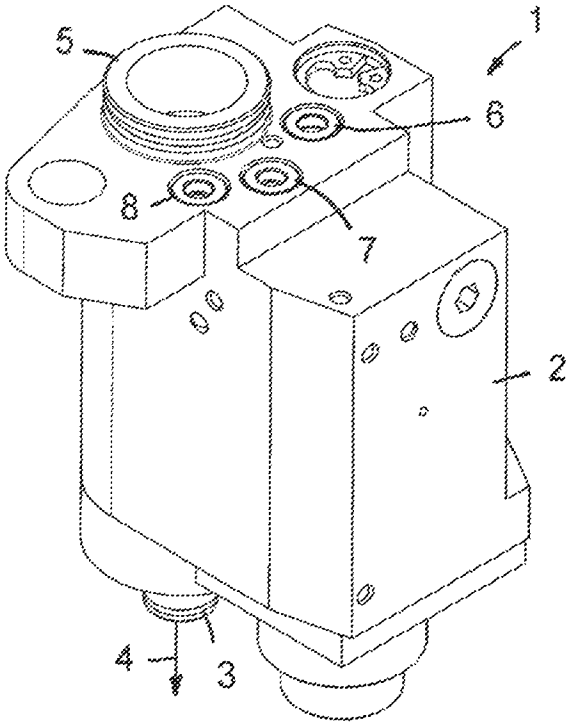
FIG. 2 is a bottom view of the spray nozzle shown in FIG. 1.

FIGS. 1 and 2 are perspective views of a spray nozzle 1 for spraying a release agent, for example an oil, into a cavity or onto the surface of a mold. The spray nozzle 1, which may be part of a spraying tool, comprises a nozzle housing 2 from which a nozzle body 3 extends which is in the form of a nozzle body ball and is supported in the nozzle housing 2 in a corresponding ball joint so that the nozzle body 3 can be pivoted about up to three rotational axes. Via the nozzle body 3 the release agent is sprayed out in the discharge direction 4 in the form of a spray cloud.

As apparent from the perspective view of the spray nozzle according to FIG. 2 there are several inlet openings 5 to 8 at the bottom side of the spray nozzle 1 via which different media can be supplied to the spray nozzle 1. Via the inlet opening 5 spray air is introduced which is mixed with the release agent to generate a spray cloud which is discharged via the nozzle body 3. The spray air and the release agent are mixed in the nozzle body 3 within an outwardly open cavity 18 or already upstream of the nozzle body 3 in a passage 19 via which the release agent is supplied to the nozzle body 3.

The release agent is supplied to the nozzle housing 2 via another inlet opening 6. There are further two more inlet openings 7 and 8 via which control air is supplied to the spray nozzle 1. The control air is pressurized and is used for controlling the movement of a dosing member for changing the volume of the release agent to be discharged and for controlling the movement of the venting unit in the spray nozzle.

Figure 5:
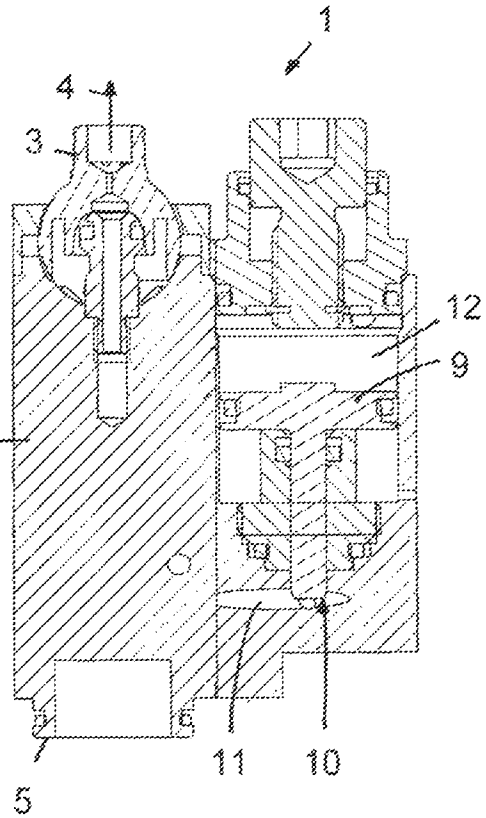
FIG. 5 is a representation of the spray nozzle as shown in FIG. 4 wherein however the dosing member is shown in the activated position.
Figure 4:
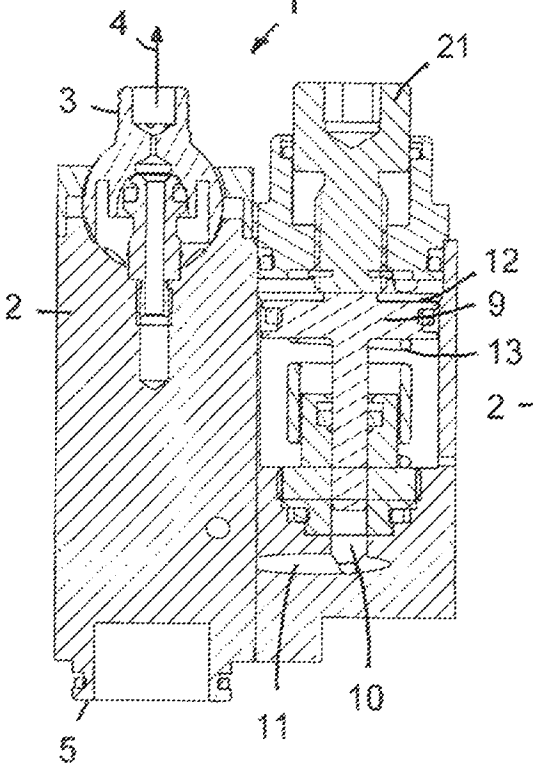
FIG. 4 is a cross-sectional view of the spray nozzle taken along line A-A of FIG. 3 showing a dosing member in the spray nozzle for the expulsion of the release agent in a base position.
Figure 3:
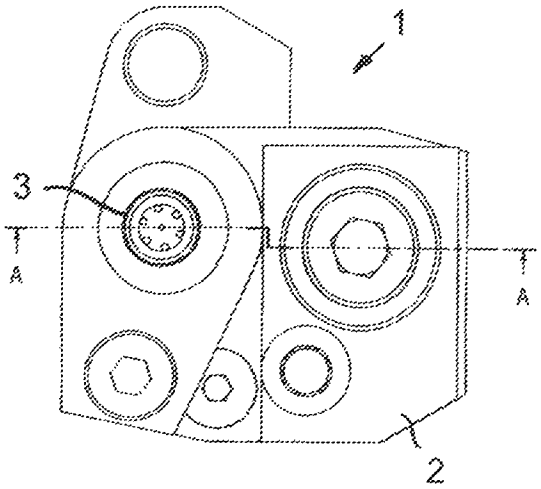
FIG. 3 is a top view of the spray nozzle shown in FIG. 1.

FIGS. 4 and 5 are sectional views taken along line A-A of FIG. 3. They show a cross-section of the nozzle housing 2 of the spray nozzle 1. Shown therein is a dosing member 9 in the nozzle housing 2, in FIG. 4 in the initial position and in FIG. 5 in the displacement position, which dosing member is used for the displacement of the release agent from a dosing chamber 10 via a discharge channel 11 to the nozzle body 3. The dosing member is in the form of a dosing piston 9 whose front end delimits the dosing chamber 10 so that an axial displacement along the longitudinal piston axis of the dosing piston 9 results in a volume reduction of the dosing chamber 10 and a release agent displacement of the same volume out of the dosing chamber 10 toward the nozzle body 3. The dosing piston 9 is axially movably supported in an operating chamber 12 provided in the nozzle housing 2. In the area above the dosing piston 9 control air under an operating or control pressure of for example 6 bar is admitted to the operating chamber 12 whereby the dosing piston 9 is moved from its initial position as shown in FIG. 4 to its displacement position as shown in FIG. 5. This movement is performed against the force of a spring element 13 (FIG. 4) which is supported in the nozzle housing 2 so as to bias the dosing piston 9 into its initial position. After completion of the spraying procedure the pressure of the control air in the upper area of the operating chamber 12 above the dosing piston 9 is reduced whereby the dosing piston 9 is returned by the force of the spring element 13 to its initial position.

The volume of the dosing chamber 10 can be adjusted by a set screw 21 (FIG. 4) which forms a control element. The set screw 21, can be adjusted from without for changing the position of the set screw 21 within the housing. The front end of the set screw 21 forms a stop—or support surface for the dosing piston 9, so that its initial position depends on the position of the set screw 21.

Figure 8:
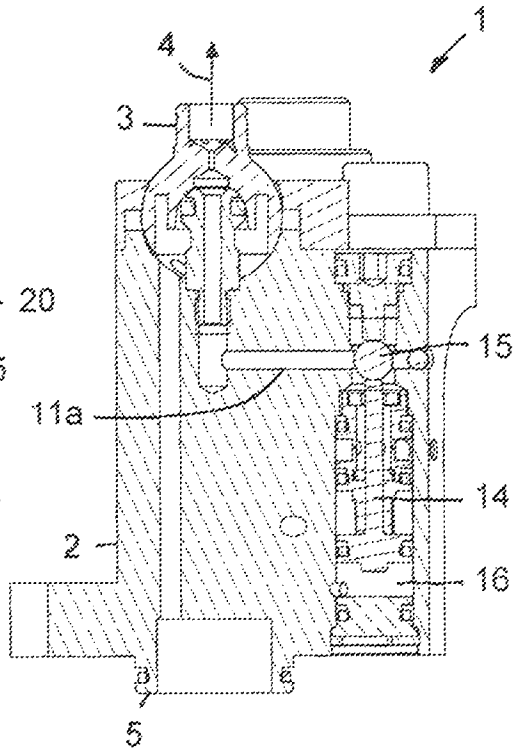
FIG. 8 shows the spray nozzle as shown in FIG. 7 with the venting unit in the venting and opening position.
Figure 7:
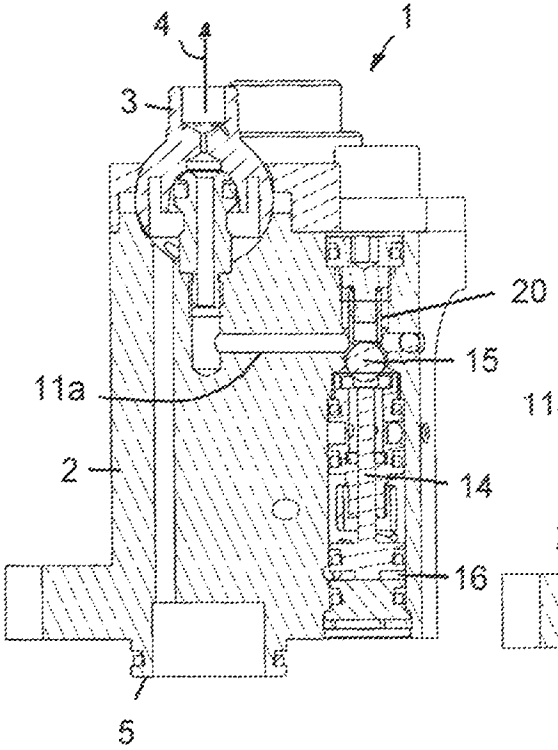
FIG. 7 is a cross-sectional view of the spray nozzle of FIG. 1 taken along the line B-B of FIG. 6.
Figure 6:
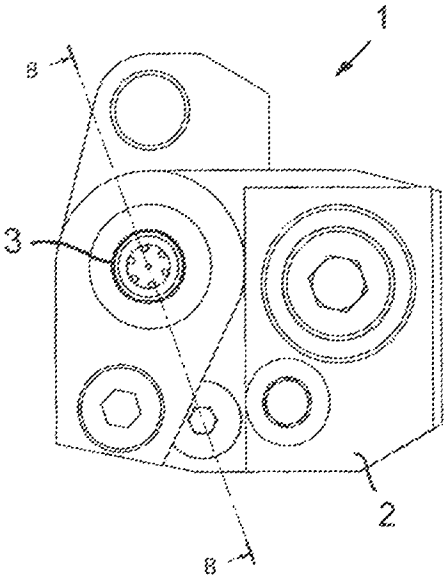
FIG. 6 is a view like FIG. 3 showing a different cross-sectional line B-B.

FIGS. 7 and 8 are further cross-sectional views of the spray nozzle taken along line B-B of FIG. 6. The cross-sectional area of the view is angularly displaced with regard to the cross-sectional views of FIGS. 3 to 5. In FIGS. 7 and 8 a venting unit 14 is shown which serves to vent the dosing chamber 10 and possibly also the discharge channel 11 if air has collected in the dosing chamber 10 or, respectively, in the discharge channel 11. In that case normal operation of the spray nozzle that is the spraying of release agent is not possible since, because of the high compressibility of the air in the dosing chamber, the movement of the dosing piston 9 does not result in a proper discharge of the release agent but essentially only to a compression of the air or gas volume in the dosing chamber 10.

The venting unit 14 is in the form of a venting piston which extends in the nozzle housing 2 parallel to the dosing piston but in spaced relationship therefrom. The venting piston 14 is axially movable between the dysfunctional position shown in FIG. 7 and the venting and opening position shown in FIG. 8. The front end of the venting piston 14 faces a check valve 15 in the form of a check valve ball which is arranged in the flow passage of the release agent from the dosing chamber 10 to the nozzle body 3 in a section 11*a* of the discharge channel 11. The check valve ball 15 is movable between a blocking position and an opening position. In the blocking position (FIG. 7) a flow of release agent or air through the discharge channel 11 is prevented; in the opening position (FIG. 8) the flow is possible.

During regular operation—that is without any air in the dosing chamber 10—the release agent is discharged by the operating movement of the dosing piston 9 via the discharge channel 11 and the nozzle body 3. Herewith the check valve ball 15 is lifted out of the blocking position as shown in FIG. 7 to the opening position as shown in FIG. 8. The opening position is above the blocking position. Upon completion of the discharge procedure the check valve ball 15 moves spring-based from the opening position back to the blocking position.

The venting piston 14 is normally in the retracted initial position as shown in FIG. 7, in which the venting piston does affect the movement of the check valve ball 15. But by the movement of the venting piston 14 out of the dysfunctional position as shown in FIG. 7 to the venting and opening position as shown in FIG. 8 in which the venting piston is raised. The top end of the venting piston 14 pushes the check valve ball 15 off its blocking position to its opening position in which the flow passage through the discharge channel 11 is cleared. With an operating movement of the dosing piston 9 the free volume of the dosing chamber 10 is reduced and air present in the dosing chamber 10 and possibly in the discharge channel 11 is discharged via the now open discharge channel 11 and the nozzle body 3. The venting procedure is terminated when the dosing piston 9 returns again to its initial position and the venting piston 14 returns to its dysfunctional position.

The venting piston 14 is lifted from the dysfunctional position as shown in FIG. 7 to the venting and opening position as shown in FIG. 8 by means of control air. The venting piston 14 is movably supported in an operating chamber 16 within the nozzle housing 2. Into the area of the operating chamber 16 at the bottom side of the venting piston 14 control air can be introduced which lifts the venting piston 14 out of the dysfunctional position into the venting and opening position.

The lifting level of the venting piston 14 depends on the pressure of the control air at the bottom side of the venting piston. Advantageously the control air needs to reach or exceed a pressure threshold value of for example 8 bar in order to lift the venting piston 14. This pressure threshold value is above the normal pressure of for example 6 bar which is applied to the dosing piston to move it against the force of the spring element 13. The pressure difference between the normal control pressure for the operation of the spray nozzle (the lower air pressure threshold value) and the higher air pressure threshold value for the lifting of the venting piston 14 into the venting and opening position ensures that the venting piston remains during normal operation in its lower dysfunctional position. During normal operation a control pressure is also effective at the lower side of the venting piston 14 which, however is not high enough to lift the venting piston into the venting and opening position. Only when the control pressure exceeds the upper air pressure threshold value can the venting piston 14 be moved to the venting and opening position.

Upon completion of the venting procedure the pressure of the control air is reduced whereby the venting piston 14 is returned by the spring element 20 from the raised venting and opening position to the lower dysfunctional position. Subsequently the normal operating mode of the spray nozzle can again be resumed.

Figure 11:
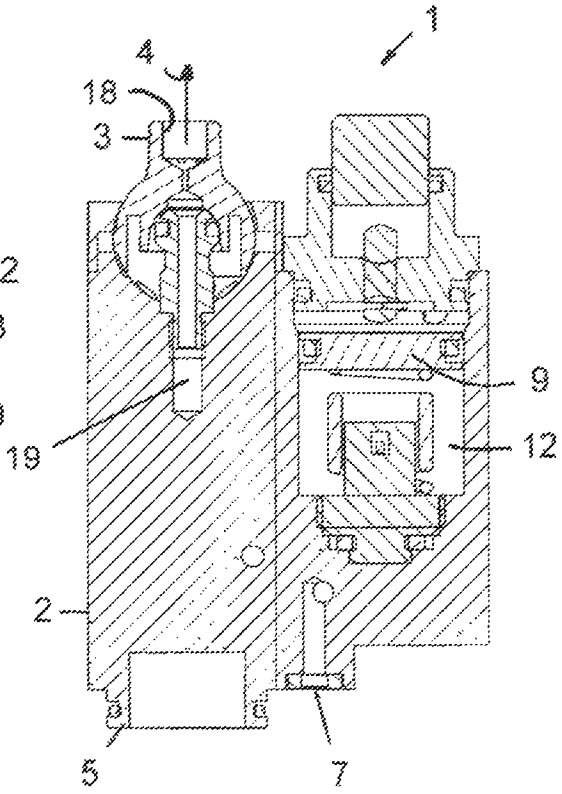
FIG. 11 is a cross-sectional view taken along line N-N of FIG. 9 showing an operating chamber and the inlet opening for the compressed control air.
Figure 10:
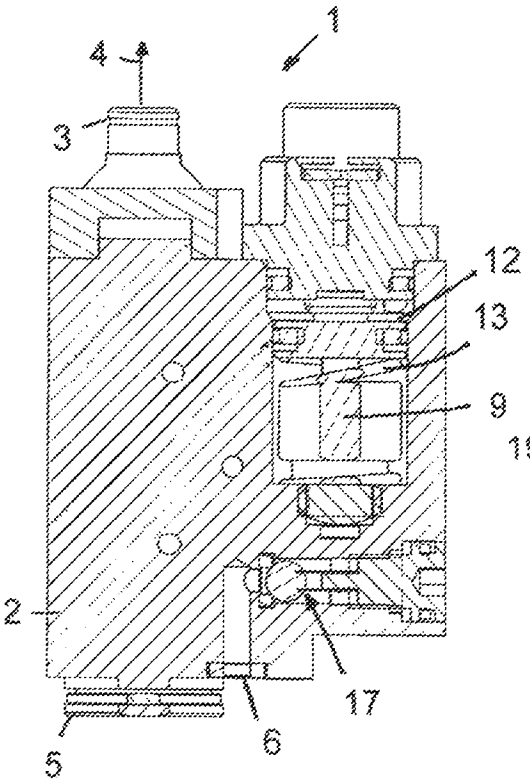
FIG. 10 is a cross-sectional view of the spray nozzle taken along line M-M of FIG. 9 showing a dosing member and a check valve in the inlet area of the release agent.
Figure 9:
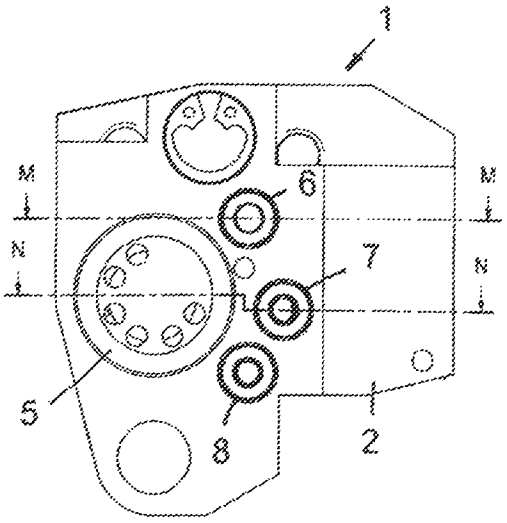
FIG. 9 is a bottom view of the spray nozzle indicating the location of cross-section lines M-M and N-N.

FIG. 10 is a cross sectional view of the spray nozzle 1 taken along line M-M of FIG. 9, and FIG. 11 is a cross-sectional view of the spray nozzle 1 taken along line N-N of FIG. 9. The cross-sections extend through the inlet opening 6 for the release agent (FIG. 10) and, respectively, the inlet opening 7 for the control air (FIG. 11). The release agent is supplied via the inlet opening 6 and a check valve 17 to the dosing chamber 10. The control air is supplied via the inlet opening 7 and—via the additional inlet opening 8—to the operating chamber 12 above the dosing piston 9 and to the operating chamber 16 below the venting piston 14.

What is claimed is:

1. A spray nozzle (1) for a spraying tool for spraying a release agent into a mold, comprising a nozzle housing (2) with a dosing chamber (10) into which the release agent can be introduced, a dosing member (9) in the form of a dosing piston insertable into the dosing chamber (10) for changing the volume thereof and resulting in a displacement of the release agent from the dosing chamber (10) via a discharge channel (11) including a check valve (15) to a nozzle body (3) via which the release agent is to be discharged, the check valve (15) having an open and a blocking position, and an active venting unit (14) integrated into the nozzle housing (2) for venting the dosing chamber (10), the venting unit (14) is in the form of a venting piston which is movable along its longitudinal axis between a dysfunctional position and a venting and opening position, the venting piston (14) being operable by application of an activation value capable of automatically transferring the venting piston (14) from the dysfunctional position to the venting and opening position in which the check valve (15) is held in an open position by the venting piston (14), wherein for holding the check valve (15) in the open position in a venting and opening state, the venting piston (14) is adapted to engage the check valve (15), wherein an activation value of the venting piston (14) is the same as an activation value of the dosing piston (9) for changing the volume of the dosing chamber (10), wherein the venting piston (14) is activatable by exceeding a particular threshold of the activation value;

wherein the activation value for the venting piston (14) is the pressure of a pressurized control air;

wherein the pressurized control air for the dosing piston (9) and for the venting piston (14) is supplied via a common control air supply passage, wherein the venting piston (14) becomes activated upon exceeding a particular threshold of the activation value of pressurized control air of the common control air supply passage, and, wherein, at a certain common lower control air threshold pressure value of the common control air supply passage, only the dosing piston (9) is movably activated for changing the dosing chamber (10) volume while the venting piston (14) remains stationary and, at a certain common higher control air threshold pressure value of the common control air supply passage, both, the dosing piston (9) and the venting piston (14) are both movably activated and the venting piston (14) moves the check valve (15) from the blocking position to the open position for venting the dosing chamber (10).

2. The spray nozzle according to claim 1, wherein the check valve (15) comprises a check valve ball arranged in the discharge channel (11).

3. The spray nozzle according to claim 1, wherein the venting unit (14) is biased toward its dysfunctional position by a spring element (20).

4. A spraying tool with a spray nozzle (1) according to claim 1.

* * * * *